US007504944B2

(12) United States Patent
Marszalek et al.

(10) Patent No.: US 7,504,944 B2
(45) Date of Patent: Mar. 17, 2009

(54) APPARATUS, SYSTEM AND METHOD FOR SECURING A DEVICE

(75) Inventors: Christopher Marszalek, Plainfield, IL (US); Daniel Horvath, Plainfield, IL (US); Sorin Petrusan, Chicago, IL (US)

(73) Assignee: Sennco Solutions, Plainfield, IL (US)

( * ) Notice: Subject to any disclaimer, the term of this patent is extended or adjusted under 35 U.S.C. 154(b) by 451 days.

(21) Appl. No.: 11/284,276

(22) Filed: Nov. 21, 2005

(65) Prior Publication Data

US 2007/0125472 A1 Jun. 7, 2007

(51) Int. Cl.
*G08B 12/312* (2006.01)

(52) U.S. Cl. ..... 340/568.2; 340/571; 340/568; 340/693

(58) Field of Classification Search ..... 340/568, 340/571, 693
See application file for complete search history.

(56) References Cited

U.S. PATENT DOCUMENTS 5,072,213 A 12/1991 Close
5,570,080 A * 10/1996 Inoue et al. ..... 340/571
5,886,633 A * 3/1999 Adams ..... 712/227

* cited by examiner

*Primary Examiner*—Jeff Hofsass
*Assistant Examiner*—Ojiako Nwugo
(74) *Attorney, Agent, or Firm*—Patents & TMS, P.C.

(57) ABSTRACT

An apparatus, a system and a method for securing a device are provided. The device may be an electronic device, an input device, an output device, a portable media storage unit, a portable electronic device and/or the like. An apparatus and a system for securing the device may attach and/or may connect the device and/or a detachable element of the device to a housing. A flap may attach to, secure to and/or connect the housing to the device. A light emitting element may indicate that the housing is attached to and/or secured to the device and/or the detachable element of the device. Attaching, securing and/or connecting the housing to the device may depress a plunger. Removing and/or separating the housing from the device may move the plunger outward with respect to the housing. A circuit may be closed, opened and/or activated by the plunger. The circuit may attach to, may connect to and/or may communicate with a security system which may be an alarm, an alarm box, an alarm board and/or the like. A cable may connect to and/or may communicate with the security system.

20 Claims, 2 Drawing Sheets

FIG. 1
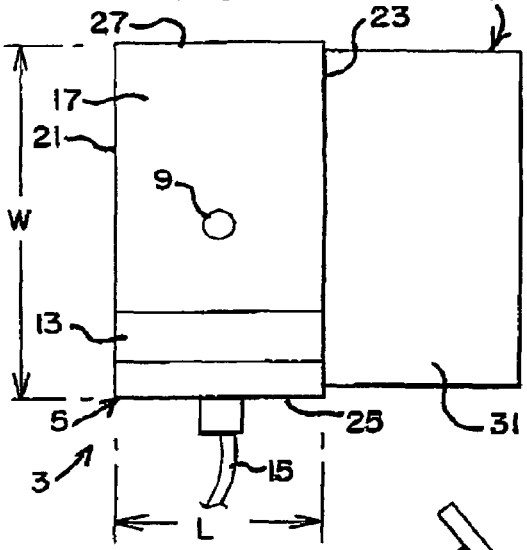
FIG. 2
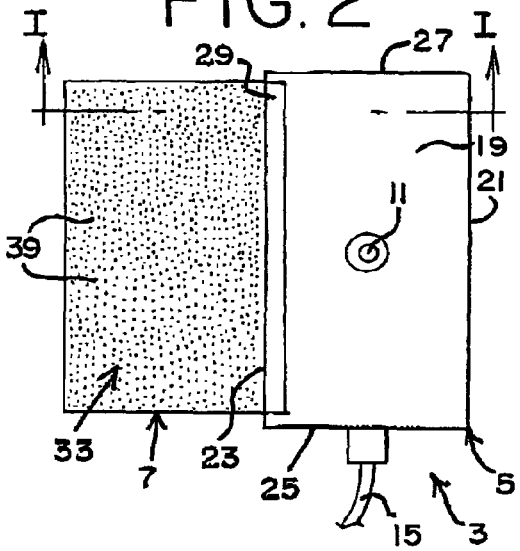
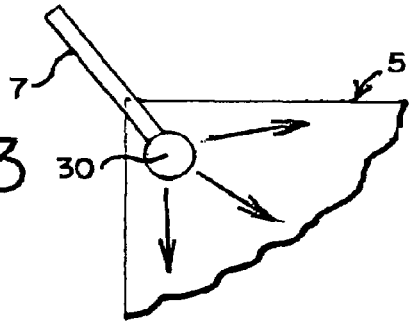
FIG. 3
FIG. 4
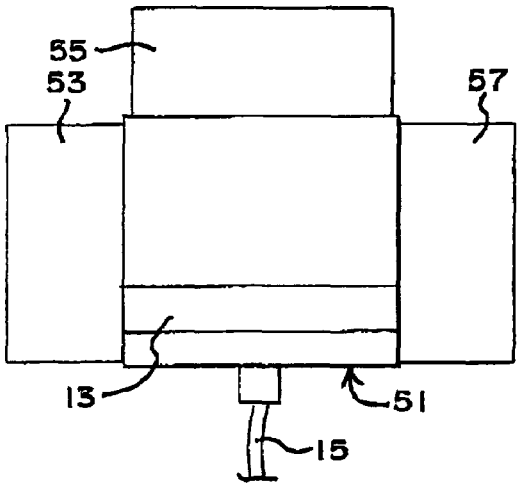
FIG. 5
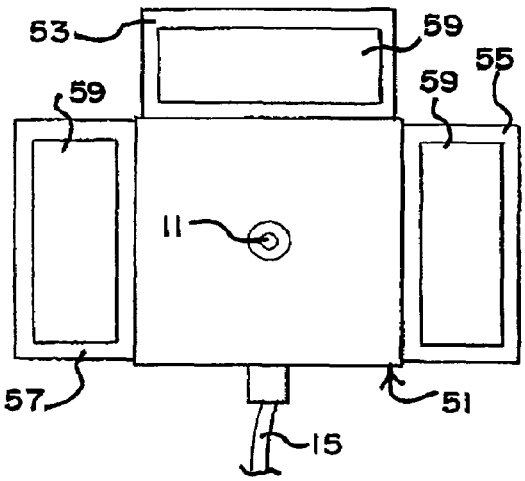

APPARATUS, SYSTEM AND METHOD FOR SECURING A DEVICE

BACKGROUND OF THE INVENTION

The present invention generally relates to an apparatus, a system and a method for securing a device. More specifically, the present invention relates to an apparatus, a system and a method for securing a device which may be an electronic device, such as, for example, a camera, a camcorder, a digital camera, a digital music player, a video game, a digital video player, a digital video recorder, a personal data assistant (hereinafter "a PDA"), a cellular telephone, and/or the like. The apparatus, the system and the method for securing the device may have a housing attached to, secured to and/or connected to a security system to prevent theft of and/or destruction of the device. The security system may be, for example, an alarm box, an alarm board, an alarm or the like.

A circuit, a light emitting element and/or a plunger may be contained within the housing. The plunger may be connected to, attached to and/or in communication with the circuit which may control and/or activate the light emitting element. The circuit may control the light emitting element to indicate whether the device is secured to the housing. The plunger may be depressed and/or lowered to secure and/or to connect the device to the housing. A flap may be connected to, formed to, secured to and/or extended from the housing. The flap may have an adhesive which may attach, may connect and/or may secure the device to the housing. The housing may have a recession to attach and/or to secure the housing to the device. A cable may attach and/or may connect the housing to the security system.

It is generally known, for example, that vendors, retailers and/or wholesalers may display a device to a customer at, for example, a retail store and/or a sales facility for examination and/or inspection by the customer. The device may be a camera, a digital camera, a portable compact disc player, a PDA and/or a cellular telephone. The device is traditionally displayed in conjunction with a fixture, such as, for example, a cabinet, a table, a wall, a column, a shelf and/or the like. Generally, a cable attaches the device to the fixture. The device is secured to the fixture by the cable attached to a frame surrounding the device. The frame is often heavy and cumbersome. As a result, the frame prevents a user and/or a customer from examining the device and/or a detachable element of the device. For example, the frame prevents the user and/or customer from, for example, examining the various characteristics of the device, such as, for example, the weight, the texture, the feel, the configuration, the appearance and/or the like. Further, the frame must be unique to a device and/or devices of similar sizes. For example, the frame for a rectangular device is not suitable to fit a circular device.

In addition, the device may have a detachable element, such as, for example, a camera lens, an ear piece, head phones, a head set, a wireless head set, a battery, a speaker, a case to hold the device therein and/or the like. The frame surrounding the device generally surrounds the detachable element and the device. Accordingly, the frame prevents the user and/or customer from examining the detachable element. Alternatively, the frame may surround the device but fail to secure the detachable element to the fixture. As a result, the detachable element may be damaged, stolen or the like.

A need, therefore, exists for an apparatus, a system and a method for securing the device. Additionally, a need exists for an apparatus, a system and a method for securing the device to a security system which may provide mechanical security and electrical security to the device and/or the detachable element of the device. Further, a need exists for an apparatus, a system and a method for securing the device to a security system which may visibly indicate that the device and/or the detachable element of the device is mechanically secured and/or is electrically secured. Still further, a need exists for an apparatus, a system and a method for securing the device to the security system which may allow a user and/or customer to examine the detachable element of the device. Moreover, a need exists for an apparatus, a system and a method for securing the device to the security system which may trigger an alarm when the device and/or the detachable element of the device is separated from the security system and/or the housing. Furthermore, a need exists for an apparatus, a system and a method for securing the device to the security system having a circuit to power a light emitting element which may indicate the device and/or detachable element of the device is secure. In addition, a need exists for an apparatus, a system and a method for securing a device with a flap which may adjust to a range of sizes and configurations of devices. In addition, a need exists for an apparatus, a system and a method for securing the detachable element and the device with a single apparatus. Further, a need exists for an apparatus, a system and a method for securing the device and/or the detachable element of the device which may allow a user and/or a customer to examine the detachable element.

SUMMARY OF THE INVENTION

The present invention relates to an apparatus, a system and a method for securing a device, such as, an electronic device, to a security system, such as, for example, an alarm box, an alarm board an alarm and/or the like. The device may be, for example, an electronic device, such as, for example, a camera, a cellular phone, a PDA, a digital musical player, a portable media player or the like. Further, the apparatus, the system and the method for securing the device may attach, may connect and/or may secure the device to the security system via a housing, a flap and/or a cable. The apparatus, the system and the method for securing the device may attach and/or may secure a detachable element of the device to the housing, the cable and/or the flap. The housing may have a circuit and/or a plunger which may control and/or activate a light emitting element. The circuit may be closed by, may be opened by and/or may be in communication with the plunger. The plunger may be depressed and/or lowered to secure the device to the housing. Further, the housing may have a recession which to connect, to attach and/or to secure the housing to the device.

To this end, in an embodiment of the present invention, an apparatus for securing a device or a detachable element is provided. The apparatus has a housing having an interior wherein the housing has a height defined between a top side and a bottom side and a width defined between a first end and a second end wherein the housing contacts the device and further wherein the first end of the housing has an opening. Further, the apparatus has a flap having a top surface and a bottom surface wherein the bottom surface of the flap attaches to the device and further wherein the flap extends from the interior of the housing through the opening.

In an embodiment, the apparatus has a light emitting element connected to the housing wherein the light emitting element is activated when the device contacts the housing.

In an embodiment, the apparatus has a plunger operatively connected to the housing wherein the plunger extends from the housing and further wherein the housing attaches to the device so that the plunger contacts the device.

In an embodiment, the apparatus has a pin integrally formed with the flap wherein the pin is movable within the interior of the housing.

In an embodiment, the apparatus has a recession on the top side of the housing wherein the recession extends from the first end to the second end.

In an embodiment, the apparatus has an adhesive adhering the flap to the housing.

In another embodiment of the present invention, a system for securing a device or a detachable element is provided. The system has a housing having an interior wherein the housing has a length and a width wherein the length is defined between a first end and a second end and the width is defined between a front end and a back end wherein the housing has a height defined between a top side and a bottom side. Further, the system has a flap connected to the housing wherein the flap extends from the interior of the housing to a first distance exterior to the housing and further wherein the flap has a first portion and a second portion wherein the first portion is within the interior of the housing and the second portion attaches to the device. Still further, the system has a plunger connected to the housing wherein the plunger contacts the device and further wherein the housing depresses the plunger when the flap is secured to the housing.

In an embodiment, the system has a light emitting element on the housing wherein the plunger depresses to activate the light emitting element.

In an embodiment, the system has an opening in the first end of the housing wherein the flap extends through the opening.

In an embodiment, the system has an adhesive on the flap wherein the adhesive secures the flap to the device.

In an embodiment, the system has a second flap operatively connected to the housing wherein the second flap attaches to the detachable element of the device.

In an embodiment, the system has a recession on the top side of the housing wherein the recession forms an area having a height less than the height of the housing and further wherein the recession extends from the first end to the second end.

In an embodiment, the system has a cable connected to the housing wherein the cable provides an electrical signal to the housing.

In another embodiment, a method for securing a device or a detachable element of the device is provided. The method has the step of providing a housing having an interior wherein the housing has a length defined between a first end and a second side and a width defined between a front end and a back end and a height defined between a top side and a bottom side. Further, the method has the step of positioning a flap to extend from the housing wherein the housing has an opening on the first end wherein the flap extends from the interior of the housing through the opening to an exterior of the housing. Still further, the method has the step of attaching the flap to the device so that the housing contacts the device.

In an embodiment, the method has the step of attaching a second flap to the detachable element of the device wherein the second flap extends from the housing.

In an embodiment, the method has the step of positioning a light emitting element to emit a visual signal exterior to the housing.

In an embodiment, the method has the step of adhering the flap to the device.

In an embodiment, the method has the step of connecting a plunger to the device wherein the housing depresses the plunger when the flap is secured to the housing.

In an embodiment, the method has the step of connecting a cable to the housing wherein the cable provides an electrical signal to the housing.

In an embodiment, the method has the step of moving the flap with respect to the interior of the housing.

It is, therefore, an advantage of the present invention to provide an apparatus, a system and a method for securing a device which may mechanically secure and/or may electrically secure the device and/or a detachable element of the device.

Another advantage of the present invention is to provide an apparatus, a system and a method for securing a device and/or the detachable element of the device to a security system.

And, another advantage of the present invention is to provide an apparatus, a system and a method for securing a device which may visibly display that the device and/or a detachable element of the device is electrically attached to the security system.

Yet another advantage of the present invention is to provide an apparatus, a system and a method for securing a device and a detachable element of the device with a single apparatus.

A further advantage of the present invention is to provide an apparatus, a system and a method for securing a device which may allow a user and/or a customer to examine the detachable elements of the device.

Moreover, an advantage of the present invention is to provide an apparatus, a system and a method for securing a device with an apparatus that can be used on a plurality of devices having a plurality of different sizes and/or a plurality of configurations.

And, another advantage of the present invention is to provide an apparatus, a system and a method for securing a device to a security system which may trigger an alarm by separating the device and/or the detachable element of the device from the apparatus.

Yet another advantage of the present invention is to provide an apparatus, a system and a method for securing a device to the security system having a circuit to power a light emitting element which may indicate the device and/or the detachable element of the device is secure.

Another advantage of the present invention is to provide an apparatus, a system and a method for securing a device which allows the detachable element of the device to be removed from the device and/or examined by a customer and/or a user.

A still further advantage of the present invention is to provide an apparatus, a system and a method for securing a device which provides a plunger for indicating that the device and/or the detachable element of the device is separated from and/or connected to the housing.

Moreover, an advantage of the present invention is to provide an apparatus, a system and a method for a device which provides a circuit in communication with a light emitting element.

And, another advantage of the present invention is to provide an apparatus, a system and a method for securing a device which has an adhesive to secure the detachable element of the device to the apparatus and/or the system.

Yet another advantage of the present invention is to provide an apparatus, a system and a method for securing a device which has a recession to attach, to secure and/or to connect the housing to the device and/or the detachable element.

Additional features and advantages of the present invention are described in, and will be apparent from, the detailed description of the presently preferred embodiments and from the drawings.

BRIEF DESCRIPTION OF THE DRAWINGS

FIG. 1 illustrates a top plan view of a housing with a cable, a flap and a light emitting element in an embodiment of the present invention.

FIG. 2 illustrates a bottom plan view of the housing with a cable, a flap and a light emitting element in an embodiment of the present invention.

FIG. 3 illustrates a cross-sectional view of the housing having a flap along line I-I in an embodiment of the present invention.

FIG. 4 illustrates a top plan view of the housing with a cable, flaps and the light emitting element in an embodiment of the present invention.

FIG. 5 illustrates a bottom plan view of the housing with the cable, flaps and the light emitting element in an embodiment of the present invention.

DETAILED DESCRIPTION OF THE PREFERRED EMBODIMENTS

Figure 6:
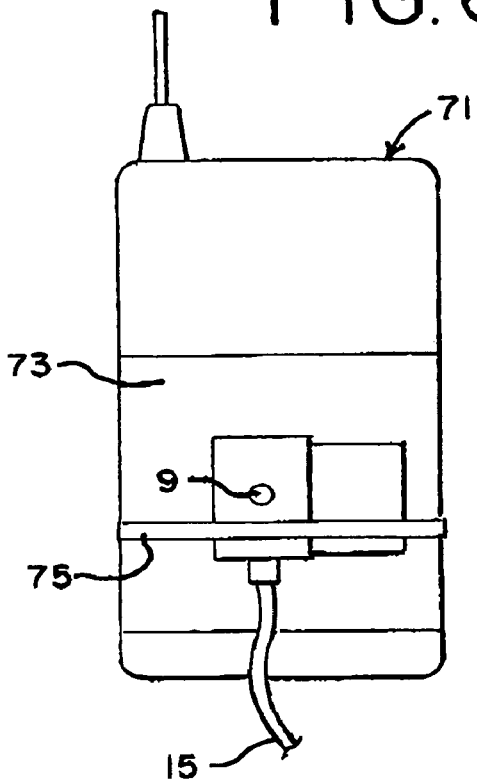
FIG. 6 illustrates a top plan view of the housing with the flap, the cable, a band and the light emitting element attached to a device in an embodiment of the present invention.

The present invention relates to an apparatus, a system and a method for securing a device. The device may be, for example, a camera, a cellular phone, a portable telephone, a digital media player, a digital music player, a remote control, a personal digital assistant ("PDA"), a dictaphone and/or the like. The system and the method for securing a device may attach and/or may secure the device and/or a detachable element of the device to a housing. A flap which may have an adhesive may be attached to, connected to and/or extend from the housing. The flap may connect and/or may secure the device and/or the detachable element to the housing.

The housing may attach to and/or secure to the device and/or the detachable element of the device to depress and/or to lower the plunger. A light emitting element may indicate that the housing is attached to and/or secured to the device and/or the detachable element of the device. A circuit which may be within the housing may control the light emitting element. The circuit via the cable may connect to and/or attach to a security system, such as, for example, an alarm system, an alarm box, an alarm and/or the like. The cable may extend outward with respect to the housing and/or the circuit which may allow the device and/or the detachable element of the device to be manipulated and/or examined by a customer and/or a user.

Referring now to the drawings wherein like numerals refer to like parts, FIG. 1 and FIG. 2 illustrate a system 3 and a housing 5 which may have a flap 7, a light emitting element 9, a plunger 11, a recession 13 and/or a cable 15. The housing 5 may be, for example, rectangularly shaped. In another embodiment, the housing 5 may be a different shape, such as, for example, a rectangle, a square, a circle, an octagon and/or the like. It should be understood that the housing 5 may be any shape known to one having ordinary skill in the art. The present invention should not be deemed as limited to the specific shape of the housing 5.

Figure 8:
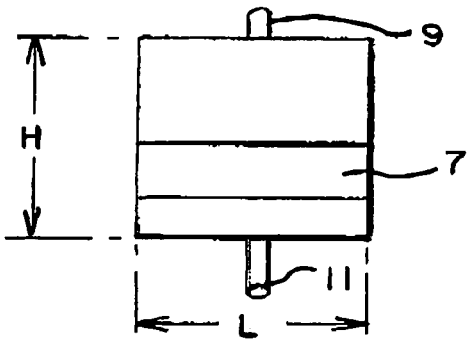
FIG. 8 illustrates a perspective view of the housing having a flap, a light emitting element and a plunger.

The housing 5 may have a top side 17 and a bottom side 19 wherein the bottom side 19 is opposite to the top side 17. The housing 5 may have a first end 21, a second end 23, a front end 25 and/or a back end 27. The second end 23 is opposite to the first end 21. The front end 25 is opposite to the back end 27. The housing 5 may have a length, L, defined between the first end 21 and the second end 23. The housing 5 may have a width, W, defined between a front end 25 and the back end 27. The housing 5 may have a height, H, defined between the top side 17 and the bottom side 19, as shown in FIG. 8. The top side 17 and/or the bottom side 19 may connect the first end 21 to the second end 23 and/or the front end 25 to the back end 27.

The top side 17 of the housing 5 may have a recession 13. The recession 13 may be, for example, a groove, a slit, a depression and/or the like on the top side 17. The recession 13 may extend from the first end 21 to the second end 23. The recession 13 may be integrally formed to the housing 5. The recession 13 may form a wall 28 defined between the top side 17 and the recession 13, as shown in FIG. 6. The wall 28 may guide and/or hold a band 75, as shown in FIG. 5.

The first end 21, the second end 23, the front end 25 and/or the back end 27 of the housing 5 may have an opening 29, as shown in FIG. 2. The opening 29 may be a slit, an aperture and/or the like. The flap 7 may extend outward from an interior of the housing 5 through the opening 29 to a distance exterior to the housing 5. Alternatively, the flap 7 may be formed to, attached to and/or connected to the first end 21, the second end 23, the front end 25 and/or the back end 27 of the housing 5.

FIG. 3 illustrates a cross-sectional view of the housing 5 having the flap 7 as taken along line I-I in an embodiment of the present invention. The pin 30 may be attached to and/or connected to the flap 7. The pin 30 may be, for example, a rod, a cylinder, a strip and/or the like. The pin 30 may be formed from, for example, plastic, rubber, metal and/or the like. Alternatively, the pin 30 may be integrally formed with the flap 7. The pin 30 may have a length that extends from the top side 17 to the bottom side 19 of the housing 5. The pin 30 may have a diameter greater than a size of the opening 29. The diameter of the pin 30 may prevent the flap 7 from being removed from the housing 5. The flap 7 and/or the pin 30 may move within the housing 5. The pin 30 may freely move within the housing 5. For example, the pin 30 may move toward the opening 29 to move the flap 7 outward with respect to the housing 5.

The flap 7 may have a top surface 31 and/or a bottom surface 33 which may be defined by a length 35 and a width 37 as illustrated in FIG. 1 and FIG. 2. An adhesive 39 may be provided on the bottom surface 33 of the flap 7. The adhesive 39 may be, for example, an epoxy, a glue, an acrylic adhesive, a very high bond adhesive and/or the like. The present invention should not be limited to the specific embodiments of the adhesive. It should be understood that the adhesive 39 may be any adhesive known to one having ordinary skill in the art.

Figure 7:
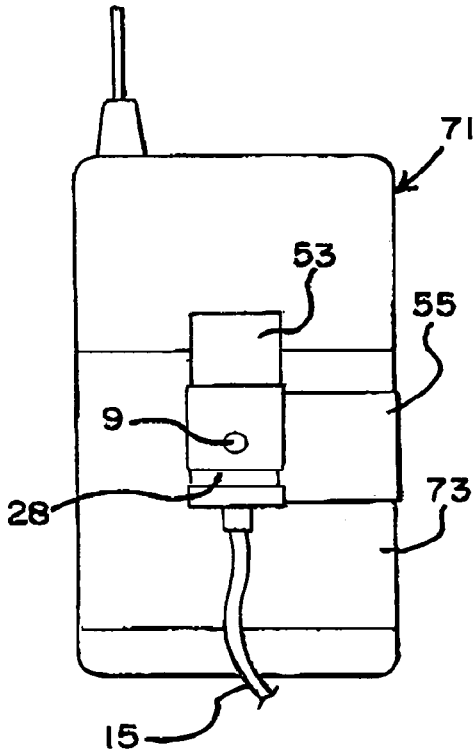
FIG. 7 illustrates a top plan view of the housing with flaps, a cable, a band and a light emitting element attached to a device in an embodiment of the present invention.

The housing 5 may be made, constructed from and/or formed from a first material, such as, for example, metal, plastic, fiberglass or the like. The plastic may be, for example, a high density polyethylene, a polyvinyl chloride ("PVC"), a polypropylene, an acrylonitrile-butadiene-styrene ("ABS") plastic and/or the like. The housing 5 may be formed, molded and/or constructed from, for example, one or more pieces and/or sections. The flap 7 may be formed from a second material, such as, for example, rubber, nylon, PVC and/or the like. The second material may be flexible, bendable and/or the like. The second material may adhere to the contours of the device 73, as shown in FIG. 6 and FIG. 7. The first material may be harder than the second material. The present invention should not be deemed as limited to the specific embodiment of the first material or the second material. It should be understood that the first material and the second material may be any materials as known to one having ordinary skill in the art.

The plunger 11 may be, for example, a lever, a button, a switch and/or the like. The plunger 11 may extend through the bottom side 19 to a first distance exterior to the housing 5. The plunger 11 may depress and/or lower to a second distance within the housing 5. The plunger 11 may be made from, for example, PVC, plastic, rubber, metal and/or the like. The plunger 11 may close and/or may open a circuit (not shown) which may activate the light emitting element 9 which may be, for example, a light emitting diode, a light bulb, a laser and/or the like. The plunger 11 may, for example, depress within the housing 5 to close the circuit and/or to activate the light emitting element 9.

The circuit may be within an interior of the housing 5. The circuit may control and/or may activate the light emitting element 9 which may extend from, connect to and/or attach to the top side 21 of the housing 5. The circuit may be electrically connected to and/or operatively attached to the plunger 11. The circuit may attach to and/or may be in communication with a security system (not shown) which may be an alarm box, an alarm, a computer, a power source and/or the like. The alarm may be, for example, a noise, such as, for example, a beeping noise, a siren noise and/or the like. The circuit may signal and/or activate the security system if the plunger 11 depresses and/or extends to the first distance. A cable 15 may attach and/or may connect the circuit to the security system. The cable 15 may be a cord, such as, for example, an electrical cord, a phone line, a cable line, a data line and/or the like. It should be understood that the security system may be any security system known to one having ordinary skill in the art. The present invention should not be deemed limited to the specific embodiments of the security system.

As illustrated in FIG. 4 and FIG. 5, the housing 51 may be square-shaped. The housing 51 may be other shapes, such as, for example, rectangular, triangular, octagonal, circular and/or the like. The housing 51 may have a first flap 53, a second flap 55 and/or a third flap 57. The present invention should not be deemed limited to a specific shape of the housing 51 and/or a specific number of flaps.

The flaps 53,55,57 may have a layer 59. The layer 59 may be, for example, a removable layer on top of the adhesive 39. The adhesive 39 may be, for example, film tape, pressure sensitive adhesive tape, acrylic tape and/or the like. The layer 59 may peel, may pull and/or may be separated from the adhesive 39 which may be located on one or more of the flaps 53, 55, 57. The layer 59 may cover, may protect and/or may shield the adhesive 39.

As illustrated in FIG. 6 and FIG. 7, the housing 5 may be attached to, may be connected to and/or may be secured to the device 71. The device 71 may be, for example, an electronic device, an input device, an output device, a portable media storage unit, a portable electronic device and/or the like. The portable electronic device may be, for example, a camera, a laptop, a personal digital assistant, a cellular phone, a two-way radio, a computer mouse, a portable media player and/or the like. The portable media player may be, for example, a digital video disc ("DVD") player and/or the like. It should be understood that the device 71 may be any device known to one having ordinary skill in the art. The present invention should not be deemed limited to a specific device.

A detachable element 73 may be attached to and/or connected to the device 71. The detachable element 73 may be a component of the device 71, such as, for example, a lens of a camera, a battery of a cell phone, a disk drive of a computer, an antenna of a personal digital assistant and/or the like. The detachable element 73 may be a product sold and/or purchased with the device 71, such as, for example, a camera case for a camera, a cover for a speaker, a holster for a cellular phone and/or the like. It should be understood that the detachable element 73 may be any detachable element known to one having ordinary skill in the art. The present invention should not be deemed limited to a specific detachable element.

The housing 5 may have flaps 53,55 which may be attached to and/or secured to the detachable element 73 and/or to the device 71. The flaps 53,55 may wrap around an edge and/or a surface of the device 71 so that the device 71 and/or the detachable element 73 may be manipulated and/or examined by a user. A band 75 may be attached to, connected to and/or on top of the recession 13 of the housing 5. The band 75 may be made from rubber, plastic, metal and/or the like. The band 75 may be, for example, a rubber band, a string, a wire and/or the like. It should be understood that the band 75 may be any band known to one having ordinary skill in the art. The present invention should not be deemed limited to a specific band.

The housing 5 may secure to the device 71 and/or the detachable element 73 to depress the plunger 11. The plunger 11 may close the circuit which may activate the light emitting element 9. The cable 15 may power the light emitting element 9 and/or may transmit a signal to the security system (not shown). The security system may be, for example, an alarm box, an alarm board, an alarm and/or the like.

In use, a user and/or a customer may manipulate the device 71 and/or the detachable element 73 by, for example, lifting, turning, feeling and/or the like. The device 71 and/or the detachable element 73 may be examined by the user and/or the customer without the flaps 53,55 separating from the device 71 and/or the detachable element 73. The device 71 and/or the detachable element 73 may be examined by the user and/or the customer without the plunger 11 moving outward with respect to the housing 5 to the first distance. If the user attempts to steal and/or to remove the device 71 to a location not desired by a merchant, a retailer and/or the like, the housing 5 may be detached, removed and/or lifted from the device 71 and/or the detachable element 73. As a result, the plunger 11 may move outward with respect to the housing 5 to the first distance which may open the circuit and activate the security system which may have an alarm. For example, the circuit may open to activate the alarm, which may produce a noise to signal to the merchant and/or retailer that the device 71 is being stolen. Alternatively, the plunger 11 may move outward with respect to the housing 5 to the first distance which may close the circuit to activate the security system, which may have an alarm.

The housing 5 may have, for example, the flaps 53,55 if the merchant desires to secure the device 71 and the detachable element 73. The merchant and/or the retailer may use the housing 5 having the flap 7 if the merchant desires to secure the device 71 or the detachable element 73. Alternatively, the merchant may use the housing 5 having the flaps 53,55 to secure the device 71 or the detachable element 73 where the device 71 or the detachable element 73 requires the flaps 53,55 to adequately secure the housing 5.

The device 71 may attach and/or may secure the device 71 and/or a detachable element 73 to the housing 5. The flap 7 which may have the adhesive 39 may be attached to, connected to and/or extend from the housing 5. The flap 7 may connect and/or may secure the housing 5 to the device 71 and/or the detachable element 73 which may depress the plunger 11. The plunger 11 may be connected to the housing 5. The light emitting element 9 may indicate that the housing 5 is attached to and/or secured to the device 71 and/or the detachable element 73. The circuit may control the light emitting element 9 which may be activated by the plunger 11. The circuit via the cable 15 may connect to and/or attach to a security system, such as, for example, an alarm system, an alarm box, an alarm and/or the like.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. An apparatus for securing a device or a detachable element, the apparatus comprising:

a housing having an interior wherein the housing has a height defined between a top side and a bottom side, a length defined between a first end and a second end and a width defined between a front end and a back end wherein the housing has a corner defined by an intersection of the bottom side and the second end wherein the bottom side of the housing contacts the device;

an opening in the corner of the housing;

a pin in the interior of the housing adjacent to the opening wherein the pin is moveable within the interior of the housing wherein the pin is sized to prevent removal of the pin from the housing through the opening; and a flap having a length defined between a first end and a second end wherein the second end is located at a position opposite to the first end wherein the flap has a thickness defined between a top surface and a bottom surface wherein the bottom surface is located at a position opposite to the top surface wherein the thickness of the flap is less than the height of the housing wherein the bottom surface of the flap attaches to the device wherein the first end of the flap is attached to the pin wherein the flap moves relative to the housing in conjunction with the pin and further wherein the flap extends from the pin in the interior of the housing through the opening.

2. The apparatus of claim 1 further comprising:

a light emitting element connected to the housing wherein the light emitting element is activated when the device contacts the housing.

3. The apparatus of claim 1 further comprising:

a plunger operatively connected to the housing wherein the plunger extends from the housing and further wherein the housing attaches to the device so that the plunger contacts the device.

4. The apparatus of claim 1 wherein the pin is integrally formed with the first end of the flap.

5. The apparatus of claim 1 further comprising:

a recession on the top side of the housing wherein the recession extends from the first end to the second end of the housing.

6. The apparatus of claim 1 further comprising:

an adhesive on the bottom surface of the flap.

7. A system for securing a device or a detachable element of the device, the system comprising:

a housing having an interior wherein the housing has a length and a width wherein the length is defined between a first end and a second end and the width is defined between a front end and a back end wherein the housing has a height defined between a top side and a bottom side;

a recession on the top side of the housing forming a groove that extends from the first end to the second end of the housing;

a first flap having a length defined between a first end and a second end wherein the second end is located at a position opposite to the first end wherein the first end of the first flap is connected to the interior of the housing wherein the first flap extends from the interior of the housing to a position outside of the housing wherein the first flap moves with respect to the housing; and a plunger extending from the bottom side of the housing wherein the plunger is connected to the housing wherein the plunger extends from the bottom side of the housing to contact the device wherein the plunger is moveable to a position within the housing.

8. The system of claim 7 further comprising:

a light emitting element on the housing that is activated when the plunger is situated in the position within the housing.

9. The system of claim 7 further comprising:

an opening in the first end of the housing wherein the first flap extends through the opening.

10. The system of claim 7 further comprising:

an adhesive on the first flap to attach the first flap to the device.

11. The system of claim 7 further comprising:

a second flap connected to the interior of the housing.

12. The system of claim 7 further comprising:

a band forming a loop sized to surround the housing and the device wherein the band is seated within the recession to prevent removal of the housing.

13. The system of claim 7 further comprising:

a cable connected to the housing wherein the cable provides an electrical signal to the housing.

14. A method for securing a device or a detachable element of the device, the method comprising the steps of:

providing a housing wherein the housing has an exterior surface surrounding an interior of the housing wherein the housing has a plunger that extends from the interior of the housing through the exterior surface of the housing in a direction outward with respect to the exterior surface of the housing and further wherein the plunger is moveable into the interior of the housing;

attaching a flap to the interior of the housing wherein the flap extends from the interior of the housing through the exterior surface of the housing to a position outside the housing;

attaching the flap to the device;

depressing the plunger into the interior of the housing; and securing the housing to the device wherein the plunger is positioned between the housing and the device.

15. The method of claim 14 further comprising the step of:

placing a band around the housing and the device.

16. The method of claim 14 further comprising the step of:

positioning a light emitting element to emit a visual signal exterior to the housing when the housing is secured to the device.

17. The method of claim 14 further comprising the step of:

placing an adhesive on the flap.

18. The method of claim 14 further comprising the step of:

connecting a circuit within the interior of the housing to detect a position of the plunger with respect to the exterior surface of the housing.

19. The method of claim 14 further comprising the step of:

connecting a cable to the housing wherein the cable provides an electrical signal to the housing.

20. The method of claim 14 further comprising the step of:

moving the flap with respect to the interior of the housing.

* * * * *